US010324421B2

(12) United States Patent
Lagorgette

(10) Patent No.: US 10,324,421 B2
(45) Date of Patent: Jun. 18, 2019

(54) OPTICAL COMMUNICATION DEVICE OF A WEARABLE OBJECT

(71) Applicant: ETA SA Manufacture Horlogere Suisse, Grenchen (CH)

(72) Inventor: Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 14 days.

(21) Appl. No.: 15/652,958

(22) Filed: Jul. 18, 2017

(65) Prior Publication Data

US 2018/0032036 A1 Feb. 1, 2018

(30) Foreign Application Priority Data

Jul. 29, 2016 (EP) ..... 16181952

(51) Int. Cl.

| | |
|---|---|
| ***G04G 5/00*** | (2013.01) |
| ***G04B 19/20*** | (2006.01) |
| ***G04G 21/00*** | (2010.01) |
| ***G04C 17/00*** | (2006.01) |

(52) U.S. Cl.

CPC ..... *G04G 5/00* (2013.01); *G04B 19/202* (2013.01); *G04C 17/0058* (2013.01); *G04G 21/00* (2013.01)

(58) Field of Classification Search

CPC ..... G04G 21/00

See application file for complete search history.

(56) References Cited

U.S. PATENT DOCUMENTS 3,987,616 A 10/1976 Castegnier
2002/0095226 A1* 7/2002 Suzuki ..... G04C 3/146 700/56

FOREIGN PATENT DOCUMENTS

GB 2486300 6/2012

OTHER PUBLICATIONS

European Search Report dated Jan. 12, 2017 in European Application 16181952.9 filed on Jul. 29, 2016 (with Engilsh Translation of Categories of cited documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece includes a case in which an electronic module supplying at least one item of information is arranged. The at least one item of information is displayed on a dial by a display. The electronic module also includes a communication unit having an optical receiving device. The optical receiving device includes at least one photoelectric receiver arranged to face a first aperture formed on the dial so that an optical signal can be received by the optical receiver.

12 Claims, 5 Drawing Sheets

OPTICAL COMMUNICATION DEVICE OF A WEARABLE OBJECT

This application claims priority from European Patent Application No.16181952.9 filed on Jul. 29, 2016; the entire disclosure of which is incorporated herein by reference.

The present invention relates to a timepiece comprising a case, in which an electronic module supplying at least one item of information is arranged, wherein said at least one item of information is displayed on a dial by display means, characterised in that the electronic module additionally comprises a communication unit having an optical receiving device, wherein said optical receiving device comprises at least one photoelectric receiver arranged to face a first aperture formed on the dial so that an optical signal can be received by said optical receiver.

PRIOR ART

There is currently a distinction made between two types of watches: mechanical watches that have no electronics and so-called electronic watches that operate with a battery and a microcontroller. Electronic watches have evolved tremendously to increasingly become so-called connected watches. These connected watches are fitted with a communication module using an NFC and/or Bluetooth module that enables the exchange of data with another device such as a mobile telephone (smart phone) or portable computer or electronic tablet. This exchange of data currently allows the transfer of data from a sensor located in the watch to the mobile phone or electronic tablet, these devices having a much superior computing power. This exchange of data also allows data such as notification or messaging to be sent from the telephone to the watch in order to inform the user.

These electronic watches can use analogue devices such as hands or discs or electronic screens using LCD, LED or OLED technologies for the display of time information such as the time or the date. The use of hands or discs requires the use of at least one motor and wheel trains so that the adjustment of the time occurs manually, which can cause inaccuracies and time shifts.

Another method of communicating is the use of optical technology using a phototransistor to receive an encoded light signal. However, this technology has the disadvantage of requiring apertures in the dial for the passage of light and is subject to risks associated with the outside light environment.

SUMMARY OF THE INVENTION

The aim of the present invention is to remedy the disadvantages of the prior art by proposing a device that enables a simple, effective optical communication that is as invisible as possible.

For this purpose, the invention relates to a timepiece comprising a case, in which an electronic module supplying at least one item of information is arranged, wherein said at least one item of information is displayed on a dial by display means, characterised in that the electronic module additionally comprises a communication unit having an optical receiving device, wherein said optical receiving device comprises at least one photoelectric receiver arranged to face a first aperture formed on the dial so that an optical signal can be received by said optical receiver, and said optical receiving device additionally comprises an occultation device interposed between the dial and the photoelectric receiver and movably mounted to be able to obstruct or let through the external optical signal.

An advantage of this invention is that it allows an optical communication between a wearable object such as a watch and another device without changing the nature of the original design. This then allows such a communication device to be incorporated into existing watches.

In a first advantageous embodiment said optical receiving device comprises two photoelectric receivers, each photoelectric receiver facing a first aperture formed on the dial, and said optical receiving device additionally comprises an occultation device interposed between the dial and each photoelectric receiver.

In a second advantageous embodiment the occultation device comprises a shutter configured in the form of a circular segment mounted on a shaft at its pointed end, wherein said shaft is driven by a motor so that the shutter can be set in rotation.

In a third advantageous embodiment the display means comprise at least one disc, which is rotatably mounted and set in rotation by at least one motor, wherein said disc carries information to be displayed through a window formed on the dial, the disc and the window serving as occultation device and first aperture respectively, and in that said disc additionally has a second aperture arranged to able to be located to face the first aperture and the photoelectric receiver to let through an optical signal.

In a fourth advantageous embodiment the disc of the display means has a plurality of positions, in each of which an item of information is located, and the second aperture is a slot located between two positions.

In a fifth advantageous embodiment the disc of the display means has a plurality of positions, in each of which an item of information is located, and said disc has an additional position, in which a second aperture is formed.

In a sixth advantageous embodiment the disc of the display means has a plurality of positions, in each of which a marking is located, and the second aperture is a slot at least partially merged with a marking.

In another advantageous embodiment the disc of the display means has a plurality of positions, in each of which a marking is located, and the second aperture is a slot at least partially merged with a marking.

BRIEF DESCRIPTION OF THE DRAWINGS

The aims, advantages and characteristics of the invention will become clearer in the following detailed description of at least one embodiment of the invention given solely as a non-restrictive example illustrated by the attached drawings, wherein.

DETAILED DESCRIPTION

Figure 1:
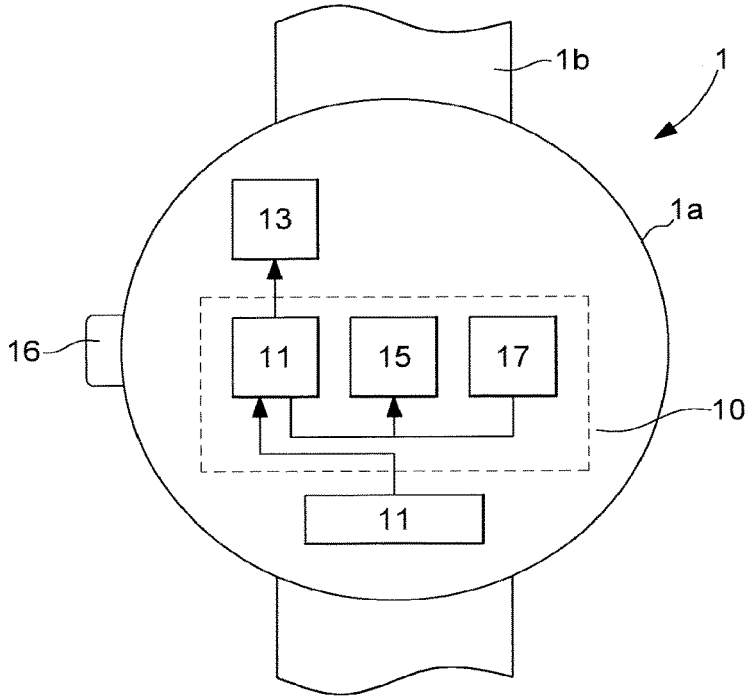
FIGS. 1 and 2 schematically show the wearable object according to the invention.
Figure 2:
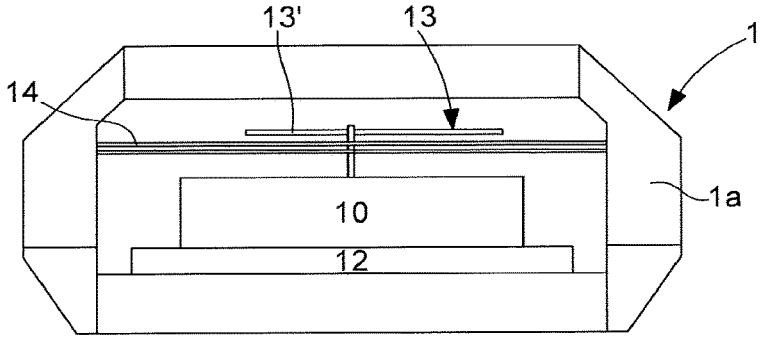

FIGS. 1 and 2 show a watch or timepiece 1 according to the invention. The watch 1 therefore comprises a case 1*a* fitted with a wristband 1*b*. Arranged in this case is an electronic module 10, which comprises a microcontroller 11 supplied with electricity by a supply unit 12 such as a battery, and said microcontroller 11 comprises a time base and memory zones. This microcontroller 11 is used in order to send control signals to display means 13, and these display means 13 may comprise hands 13' or discs that cooperate with markings of a dial 14. These display means 13 allow the display of an item of time information such as the time, but may also display the date, the day of the month or the phase of the moon. The microcontroller 11 is also connected to control means 16, which may be a crown, push buttons or touch-sensitive elements. The electronic module 10 may also comprise a communication unit 15 to receive data, and even at least one sensor 17.

According to the invention the communication unit 15 is configured to enable an optical communication. For this, the communication unit 15 comprises an optical receiving device 150 that allows reception of a light signal.

This optical receiving device 150 is advantageously located at the level of the dial 14. This optical receiving device 150 comprises at least one photoelectric receiver 151. This photoelectric receiver 151 is generally a phototransistor or photodiode, i.e. a semiconductor component having the ability to detect radiation in the optical range and transform it into an electric signal. In the case of a phototransistor, this is a bipolar transistor, the base of which is sensitive to light radiation. When the base is illuminated, the phototransistor is equivalent to a closed switch between the transmitter and the collector and when the base is not illuminated, it is equivalent to an open switch.

Figure 3:
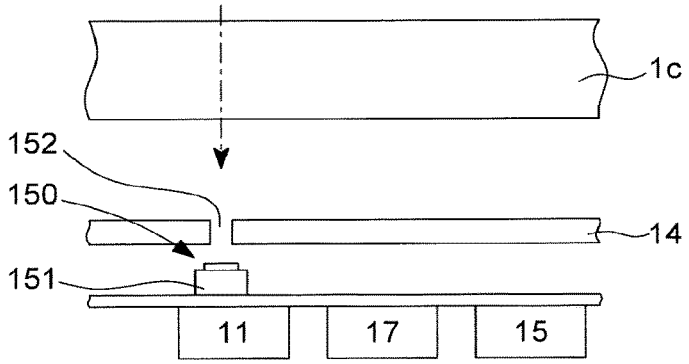
FIGS. 3 and 4 schematically show a first embodiment of the wearable object according to the invention.
Figure 4:
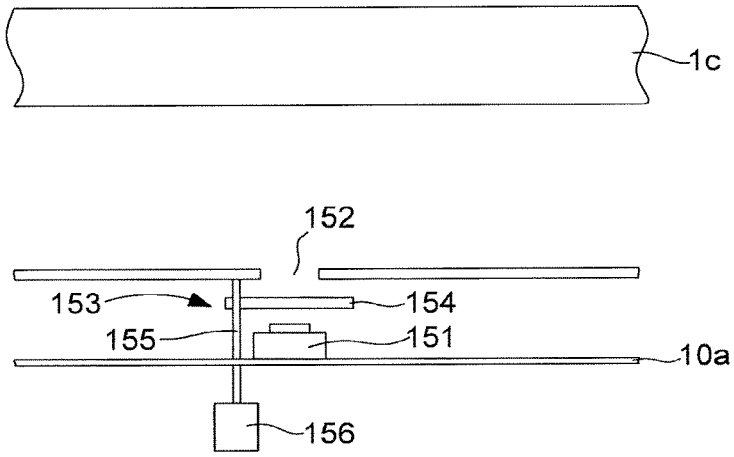

According to a first embodiment shown in FIGS. 3 and 4 the photoelectric receiver 151 is positioned under the dial 14, this having an aperture referred to as the first aperture 152. This first aperture 152 allows the light to pass through the dial 14 in order to be received by said photoelectric receiver 151. However, it is therefore necessary to conceal this first aperture 152 as far as possible so as not to impair the aesthetic appearance of the dial 14.

Figure 5:
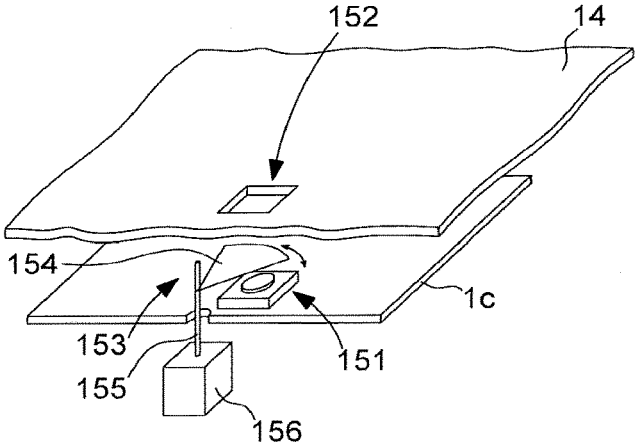
FIG. 5 schematically shows a first practical example of the first embodiment of the wearable object according to the invention.

According to a first embodiment shown in FIG. 5 the optical receiving device 150 additionally comprises an occultation device 153. This occultation device 153 consists of a shutter 154 mounted to be rotatable or to allow translational movement. This shutter 154 advantageously allows the phototransistor 151 to be concealed when this is not used. For example, the shutter 154 will be in the form of a circular segment fixed to a shaft 155 at the level of its point in order to be set in rotation by a motor 156 on demand.

Figure 6:
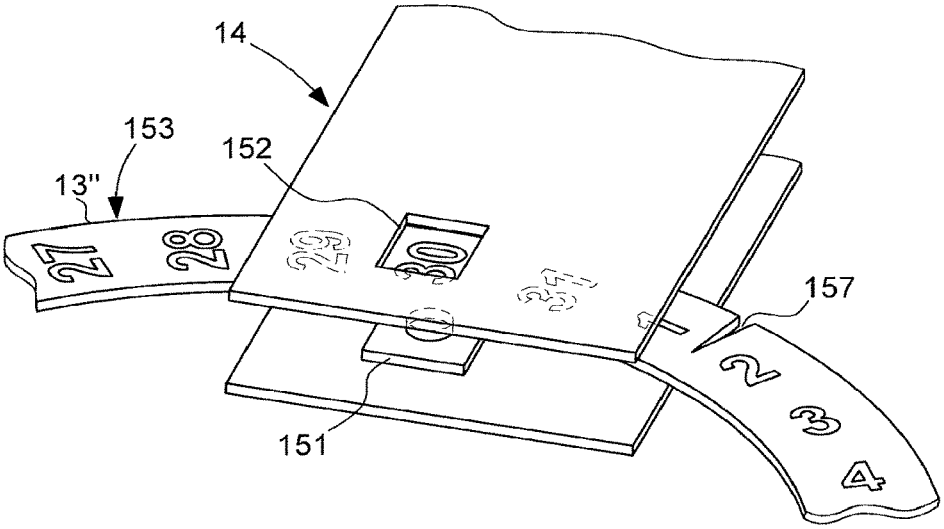
FIGS. 6 to 11 schematically show a second practical example of the first embodiment of the wearable object according to the invention.
Figure 7:
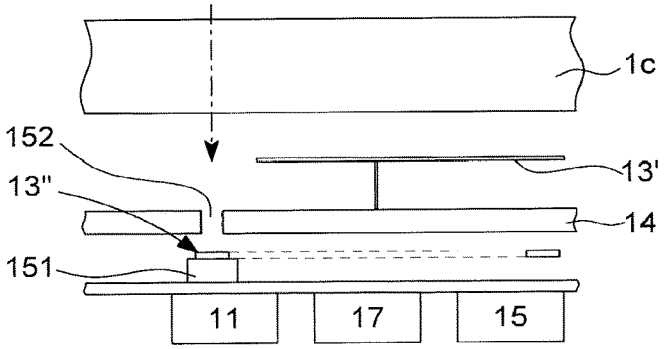

According to a second embodiment shown in FIGS. 6 and 7 the occultation device 153 is part of the display means 13. In fact, these display means 13 may comprise a disc 13", the calendar date disc, for example, to display an item of information via a window in the dial that serves as first aperture 152. This disc 13" is driven by a motor and comprises information such as the calendar date (day, month) or the phase of the moon. Astutely, this disc 13" comprises an aperture referred to as the second aperture 157. This second aperture 157 allows a light signal to pass through the dial 14. For this, the watch is capable of operating in an operating mode, in which data can be received. This mode may be activated automatically or via control means. When this operating mode is activated, the disc is set in rotation so that the second aperture of the disc is located facing the first aperture of the dial. The light signal can thus be received by the photoelectric receiver.

Figure 8:
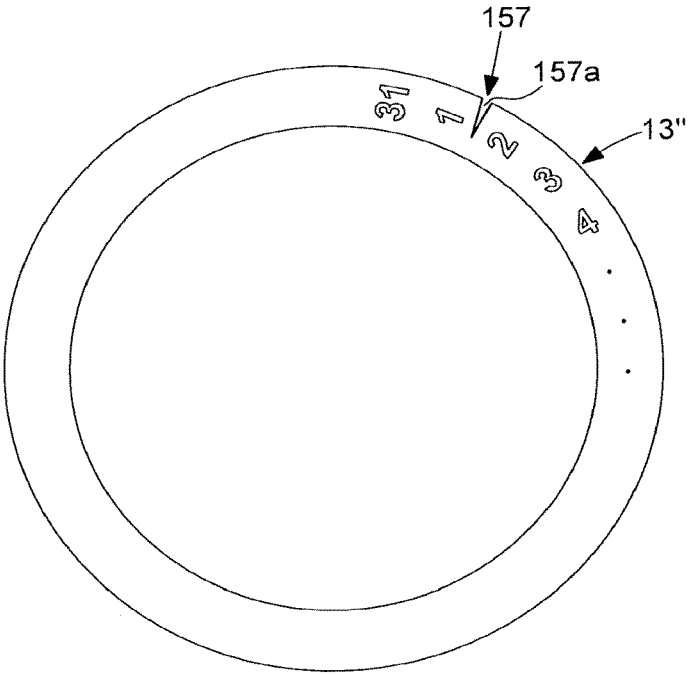
Figure 9:
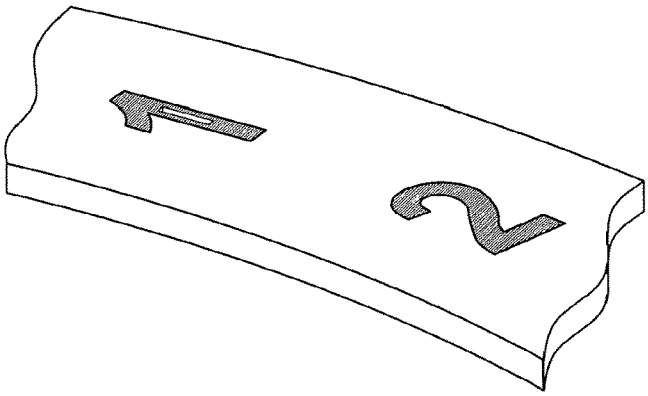

In a first practical example of this second embodiment shown in FIG. 8 the second aperture 157 of the disc 13" may be a slot 157*a*. In the case of a calendar date disc, i.e. equipped with regularly distributed markings, this slot 157*a* is located between two positions (2 dates). This slot 157*a* is located in a zone that is invisible when one date or the other is displayed. To establish the communication, the disc 13" is guided so this slot 157*a* is positioned above the photoelectric receiver 151, i.e. that it is located between two date passages. The slot 157*a* is thus aligned with the window, i.e. the first aperture 152, and the photoelectric receiver 151. The optical communication can be performed. In a particular configuration the slot 157*a* will merge into one of the markings to be as invisible as possible, as evident in FIG. 9.

Figure 10:
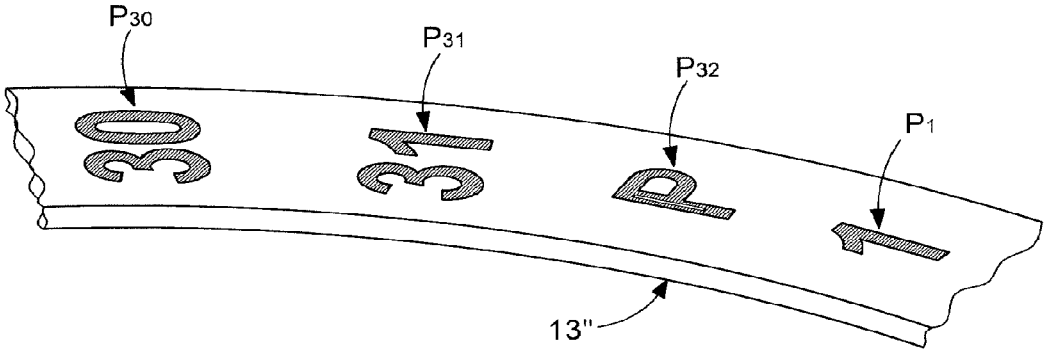
Figure 11:
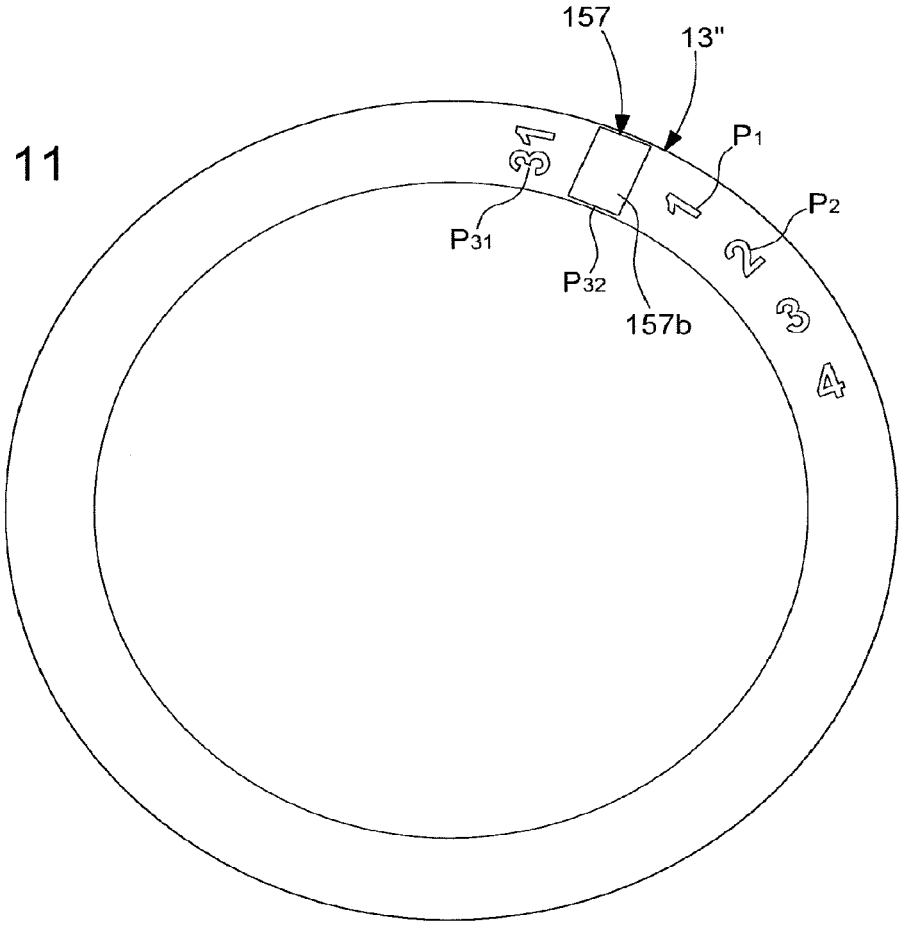

In a second practical example of this second embodiment the second aperture 157 involves punching an additional position Pi, as shown in FIGS. 10 and 11. In fact, in the case of a calendar date disc 13" thirty-one positions Pi are provided, referred to as P1 to P31, one for each day of a month. The aim here is to provide a 32nd position P32 for the second aperture. This second aperture 157 is thus configured in the form of a cutout inscription 157*b*. The cutout of the inscription allows the light to pass through to the photoelectric receiver 151. The punched inscription appears dark/black like the rest of the traced markings on the disc.

In a variant of this second embodiment the 32nd position will simply be a cut made directly in the disc. This cut thus allows the passage of light.

Figure 12A:
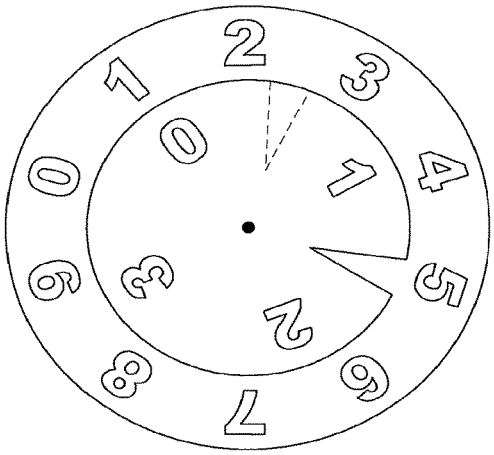
FIGS. 12*a* and 12*b* schematically show a variant of the first embodiment of the wearable object according to the invention.
Figure 12B:
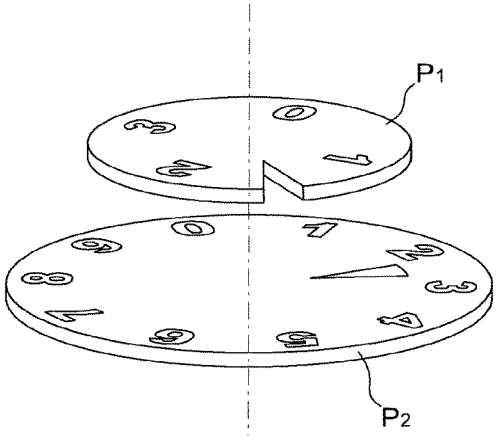

It is, of course, conceivable that in the case where the display of the calendar date uses two discs 13", referred to as D1 and D2, partially superposed to display the day of the month, each of the discs 13" is provided with this second aperture 157 as a slot or opening or cut. The discs are then set in rotation so that the openings/slots/cuts provided therein are located to face each other, as shown in FIGS. 12*a* and 12*b*.

Figure 13:
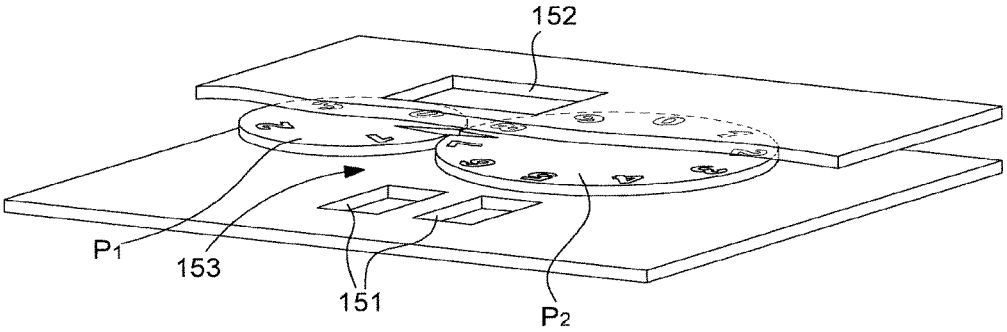
FIG. 13 schematically shows a second embodiment of the wearable object according to the invention.

In a second embodiment the optical receiving device comprises two photoelectric receivers 151, as shown in FIG. 13. The presence of two photoelectric receivers 151 allows information to be received in duplicate and thus allows the received messages to be compared. It is therefore possible to detect an error. Therefore, the dial has two first apertures: one for each photoelectric receiver 151. Each first aperture of the dial is associated with a second aperture arranged on an occultation device, which may be an information display disc (calendar date, day, phase of the moon) or a movable shutter.

For this second embodiment it is possible that the presence of the two photoelectric receivers 151 allows the use of a synchronous data transmission. In fact, such a data transmission uses a clock signal in parallel to clock the transmission of data. This thus requires having two separate receivers to send two separate signals.

According to the present invention the occultation device is set in motion after a command is received. This command may be activated via the control means of the timepiece. This latter may comprise push buttons or touch-sensitive keys enabling action on the electronic module to activate functions including a communication function.

This activation of the receipt of optical data may be performed by means of a radio signal. In fact, the communication unit may additionally comprise a Bluetooth or NFC type interface. In this case a radio signal sent by a device such as a smart phone or a beacon is received by the timepiece that will then activate the optical reception.

Moreover, the timepiece may be compatible with Li-Fi technology. This technology is a wireless communication technology based on the use of visible light ranging between radiation (480 nm wavelength, i.e. 670 THz) (perceived as blue) and radiation (650 nm, i.e. 460 THz) (perceived as red). Whereas Wi-Fi uses a radio portion of the electromagnetic spectrum outside the visible spectrum, Li-Fi uses the visible (optical) portion of the electromagnetic spectrum. The principle of Li-Fi rests on coding and transmitting data via amplitude modulation of the light sources (scintillation imperceptible to the eye) according to a well defined and standardised protocol.

It will be understood that various modifications and/or improvements and/or combinations evident to a person skilled in the art can be applied to the different embodiments of the invention outlined above without departing from the framework of the invention defined by the attached claims.

In fact, a variant of the different embodiments may be provided, in which the communication unit 15 additionally comprises an optical receiving device 150, an optical emission device allowing the emission of a light signal. Such a device generally consists of a photodiode capable of generating a light signal following an electrical excitation.

What is claim is:

1. A timepiece comprising:

a case, in which an electronic module supplying at least one item of information is arranged, wherein said at least one item of information is displayed on a dial positioned inside of the case by display means, wherein the electronic module additionally comprises a communication unit having an optical receiving device, wherein said optical receiving device comprises at least one photoelectric receiver arranged to face a first aperture formed on the dial so that an optical signal can be received by said optical receiver, and wherein said optical receiving device additionally comprises an occultation device interposed between the dial and the photoelectric receiver and movably mounted to be able to obstruct or let through the optical signal.

2. The timepiece according to claim 1, wherein said optical receiving device comprises two photoelectric receivers, each photoelectric receiver facing a first aperture formed on the dial, and said optical receiving device additionally comprises an occultation device interposed between the dial and each photoelectric receiver.

3. The timepiece according to claim 1, wherein the occultation device comprises a shutter configured in the form of a circular segment mounted on a shaft at its pointed end, wherein said shaft is driven by a motor so that the shutter can be set in rotation.

4. The timepiece according to claim 1, wherein the display means comprise at least one disc, which is rotatably mounted and set in rotation by at least one motor, wherein said disc carries information to be displayed through a window formed on the dial, the disc and the window serving as occultation device and first aperture respectively, and wherein said disc additionally has a second aperture arranged to able it to be located to face the first aperture and the photoelectric receiver to let through the optical signal.

5. The timepiece according to claim 4, wherein the disc of the display means has a plurality of positions, in each of which an item of the information is located, and the second aperture is a slot located between two of the positions.

6. The timepiece according to claim 4, wherein the disc of the display means has a plurality of positions, in each of which an item of the information is located, and said disc has an additional position, in which a second aperture is formed.

7. The timepiece according to claim 4, wherein the disc of the display means has a plurality of positions, in each of which a marking is located, and the second aperture is a slot at least partially merged with a marking.

8. The timepiece according to claim 4, wherein the disc of the display means has a plurality of positions, in all of the positions except for one position a marking is located, and the second aperture is a cut in the one position.

9. The timepiece according to claim 1, wherein the optical signal is an external optical signal.

10. The timepiece according to claim 1, wherein the timepiece is a watch.

11. The timepiece according to claim 1, wherein the information that the disc carries is a calendar date.

12. The timepiece according to claim 1, wherein the display means comprise two discs, each of the two discs is rotatably mounted and set in rotation by at least one motor, wherein each of the two discs carries information to be displayed through a window formed on the dial, the two discs and the window serving as occultation device and first aperture respectively, and wherein the two discs each additionally have a second aperture arranged to face each other and to face the first aperture and the photoelectric receiver to let through the optical signal.

* * * * *